US006367097B1

(12) United States Patent
Arnau et al.

(10) Patent No.: US 6,367,097 B1
(45) Date of Patent: Apr. 9, 2002

(54) SWIMMING POOL BOTTOM FLUSHING DEVICE

(75) Inventors: Joan Capdevila Arnau; Armand Puiggros Roig, both of Sant Jaume de Llierca (ES)

(73) Assignee: Sacopa, S.A., Sant Jaume de Llierca (ES)

( * ) Notice: Subject to any disclaimer, the term of this patent is extended or adjusted under 35 U.S.C. 154(b) by 0 days.

(21) Appl. No.: 09/632,006

(22) Filed: Aug. 1, 2000

(30) Foreign Application Priority Data

Aug. 4, 1999 (ES) ..... 9902085 U

(51) Int. Cl.[7] ..... E04H 4/00

(52) U.S. Cl. ..... 4/490; 4/492; 239/587.4; 239/205; 285/261

(58) Field of Search ..... 4/490, 492, 496, 4/506, 507, 541.6; 239/587.5, 587.4, 587.1, 206, 205, 204; 285/261, 265, 266, 399, 403

(56) References Cited

U.S. PATENT DOCUMENTS 3,578,023 A * 5/1971 Diemond ..... 137/592
3,677,474 A * 7/1972 Lorenzen ..... 239/587
4,139,221 A * 2/1979 Shotbolt ..... 285/18
4,180,285 A * 12/1979 Reneau ..... 285/261
4,438,537 A * 3/1984 Bickle ..... 4/492
4,717,078 A * 1/1988 Arp
4,919,338 A * 4/1990 Junk ..... 239/587
5,172,432 A * 12/1992 Beland ..... 4/507
6,138,293 A * 10/2000 Mathews ..... 4/492

FOREIGN PATENT DOCUMENTS

EP 536100 A1 * 4/1993

* cited by examiner

*Primary Examiner*—Robert M. Fetsuga
*Assistant Examiner*—Huyen Le
(74) *Attorney, Agent, or Firm*—Steinberg & Raskin, P.C.

(57) ABSTRACT

A swimming pool bottom flushing device comprising a tubular arrangement attached to the pipe arranged at the swimming pool bottom, and a water ejector nozzle axially fitted into said supporting arrangement in a freely rotatable, vertically shiftable arrangement. The device is characterized in that the nozzle supporting arrangement comprises a socket attached to the inside of the pipe and does also incorporate a fitted-in ball-bushing housing the nozzle. Said socket has on its inner surface alternate, longitudinal protrusions some of which have a concave profile in the vicinity of one of the socket's openings, whereas the other protrusions have said concave profile in the vicinity of the opposed one of both socket's openings.

4 Claims, 2 Drawing Sheets

SWIMMING POOL BOTTOM FLUSHING DEVICE

FIELD OF THE INVENTION

The present invention relates to a swimming pool bottom flushing device.

BACKGROUND OF THE INVENTION

This device is of the type comprising a tubular supporting arrangement glued to the PVC pipe arranged at the swimming pool bottom, and a nozzle axially fitted into said supporting arrangement in a freely rotatable, vertically shiftable arrangement, said nozzle laterally having at least one orifice through which water is ejected to flush the swimming pool bottom, means being provided between the supporting arrangement and the nozzle to determine the intermittent, partial rotation of the nozzle.

This kind of devices require the water delivery pipe to which the nozzle supporting arrangement is fitted to be laid exactly at right angles to the swimming pool bottom, since otherwise said supporting arrangement and the nozzle would be fitted up in an inclined arrangement thus hampering the flushing action to be exerted by the device since the water jets ejected from the nozzle would not properly flush the swimming pool bottom.

It is at present very difficult to achieve said accuracy since the installation of all the necessary devices at the swimming pool bottom must be carried out before the concreting of said bottom, and the water delivery pipes must be perfectly positioned and must maintain said perfect positioning all along the concrete pouring process.

This entails long hours of labor and the use of various accessories to maintain the perpendicular arrangement of the pipes, it being even in spite of this very difficult to obtain a perfect installation.

OBJECTS AND SUMMARY OF THE INVENTION

It is the object of this invention to provide a device allowing to perfectly and in a simple, quick and inexpensive way fit the supporting arrangements and their nozzles to the water delivery pipes.

This device does for such a purpose comprise a supporting arrangement formed by a ball-bushing fitted into a socket attached to the water delivery pipe, said nozzle being fitted into said ball-bushing.

In this way the nozzle will always be fitted at right angles to said bottom even if said pipe is finally laid in an inclined arrangement with respect to the swimming pool bottom.

The socket attached to the pipe has on its inner surface alternate, longitudinal protrusions of which some have a concave profile in the vicinity of one of the socket's openings, whereas the other protrusions have said concave profile in the vicinity of the opposite one of both socket's openings, the ball-bushing being fitted between said protrusions and externally having an all-around flange fitting on the open top of the water delivery pipe and on the surfacing of the swimming pool bottom.

These and other characteristics will be best made apparent by the following detailed description whose understanding will be made easier by the accompanying sheet of drawings showing a practical embodiment cited only by way of an example not limiting the scope of the present invention.

DETAILED DESCRIPTION OF THE INVENTION

Figure 5:
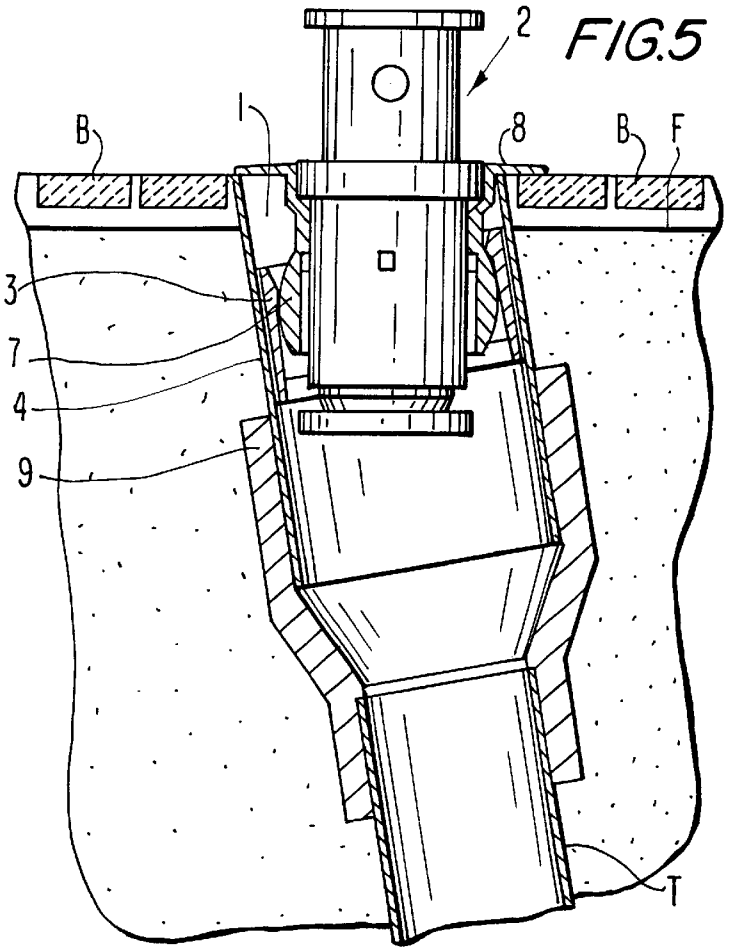
FIG. 5 is a sectional elevational view of the assembly forming the device installed at the bottom of a swimming pool, with the water delivery pipe arranged in an inclined arrangement
Figure 1:
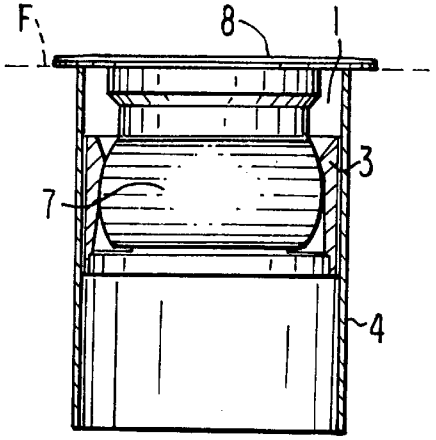
FIGS. 1 and 2 show, in a partly-sectioned elevation, the fitting of the ball-and-socket joint supporting arrangement attached to the water delivery pipe with this latter having been laid in a perpendicular or in an inclined arrangement with respect to the swimming pool bottom, respectively.

According to the drawings the swimming pool bottom flushing device comprises a tubular supporting arrangement 1 attached to the bottom F of a swimming pool, and a nozzle 2 with at least one lateral opening provided to eject the water, said nozzle being axially fitted into said supporting arrangement in a freely rotatable, vertically shiftable arrangement.

Said supporting arrangement 1 comprises a socket 3 having a cylindrical outer surface through which it is attached by means of glue to the inside of the water delivery pipe 4, said socket having on its inner surface longitudinal protrusions 5 and 5' arranged as per an alternate arrangement two by two, of which the former have a concave profile 6 in the vicinity of the open top of socket 3, whereas protrusions 5' have their concave profile 6 in the vicinity of the open bottom of said socket, a ball-bushing 7 being fitted between said protrusions and at its upper end forming an all-around flange 8 fitting on the open top of pipe 4 and on the surfacing of the swimming pool bottom F.

Figure 3:
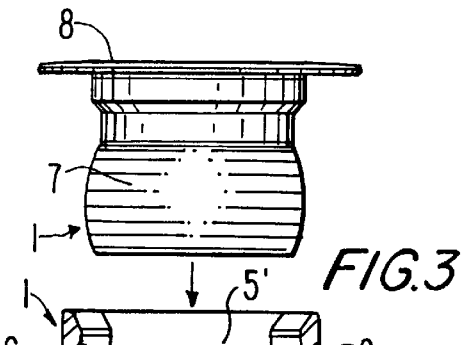
FIG. 3 is an clevational view the arrangement of the ball-bushing in order to be fitted into the socket completing the ball-and-socket joint.
Figure 4:
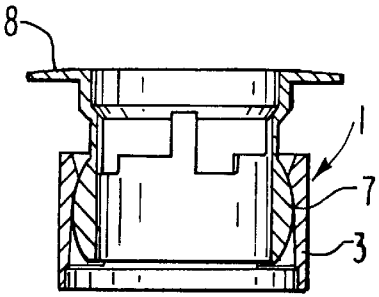
FIG. 4 is a sectional elevational view of the fitted-together arrangement of said socket and ball-bushing.
Figure 6:
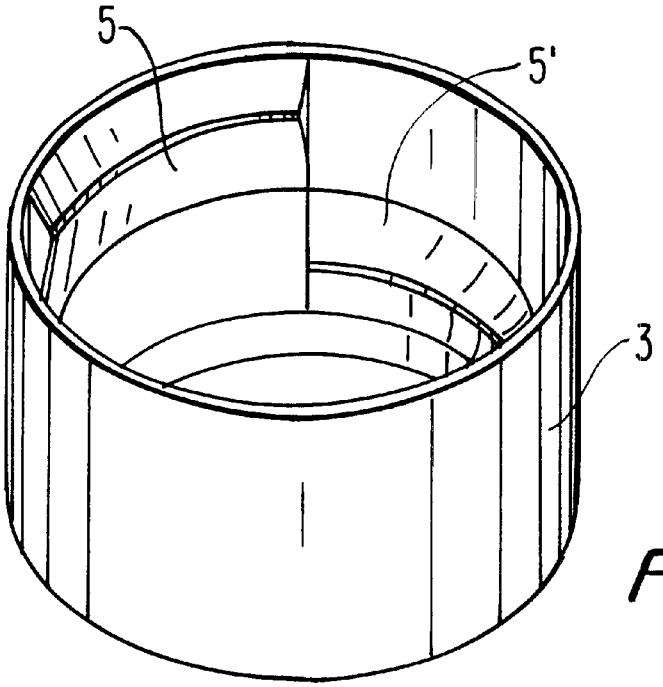
FIG. 6 is a perspective view of the socket of the device according to the invention.
Figure 7:
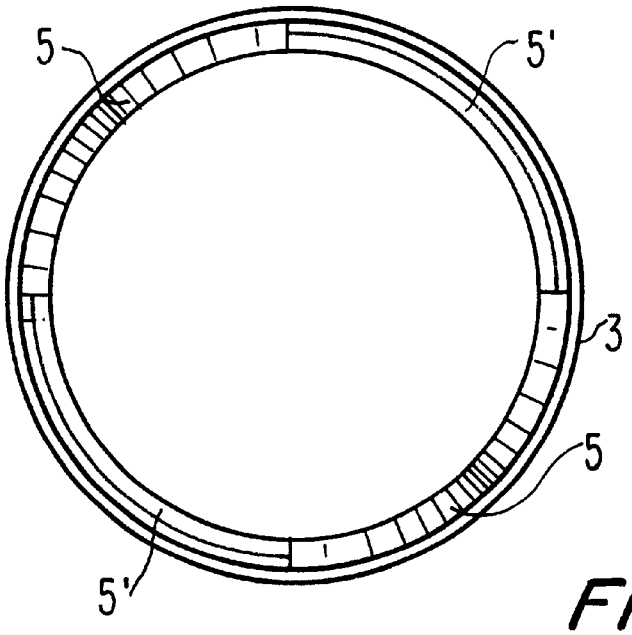
FIG. 7 is a top plan view of the socket of the device according to the invention.

In FIG. 3 is shown how to arrange ball-bushing 7 in order to fit it into socket 3. The former is arranged in a coaxial arrangement as regards the latter, and is pressed in thus causing the top lips of protrusions 5' to resiliently yield due to their thinness.

Figure 2:
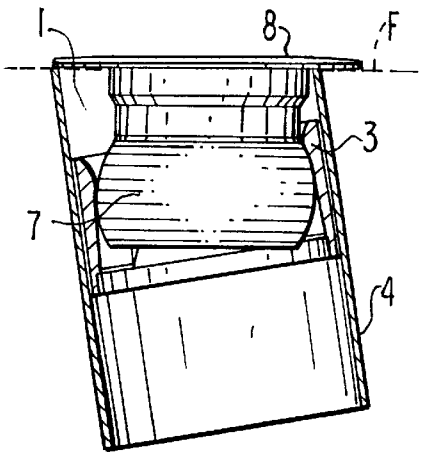

In the case of said pipe 4 having an inclined arrangement with respect to the swimming pool bottom F (FIGS. 2 and 5) the excess pipe portion projecting from said bottom will be cut off, and ball-bushing 7 will be tilted into an arrangement at right angles with respect to bottom F, nozzle 2 axially projecting from said ball-bushing to thus perfectly flush this bottom with the lateral water jets ejected from said nozzle.

The gluing of the ball-and-socket joint assembly in PVC pipe 4, together with the arrangement of flange 8 on the swimming pool bottom, determines through self-centering, the correct leveling of the device on said bottom.

In FIG. 5, it can be seen how in spite of the inclined arrangement of pipe 4 ball-bushing 7 allows to properly arrange the tiles on swimming pool bottom F, said tiles in this case being stoneware tiles B or the like.

At 9, a two-diameter coupling going from the diameter of a conventional pipe T to the diameter of pipe 4, is shown.

We claim:

1. A swimming pool bottom flushing device comprising a tubular supporting arrangement attached to a pipe arranged at the swimming pool bottom, and a water ejector nozzle axially fitted into said supporting arrangement in a freely rotatable, vertically shiftable arrangement; wherein the nozzle supporting arrangement comprises a socket attached to the inside of the pipe and does also incorporate a fitted-in ball-bushing housing the nozzle;

wherein the socket has on its inner surface alternate, longitudinal protrusions some of which have a concave profile in the vicinity of one of the socket's openings, whereas the other protrusions have their concave profile in the vicinity of the opposed one of both socket's openings.

2. A swimming pool bottom flushing device as per claim 1, wherein the ball-bushing has at its top edge an outer all-around flange fitting on top of the pipe's open top.

3. A swimming pool bottom flushing device comprising:

a tubular supporting arrangement structured and arranged for attachment to an opening of a pipe arranged at the bottom of a swimming pool, said tubular supporting arrangement having a socket attached to the inside wall thereof and a fitted-in ball bushing structured and arranged therein; and a water ejector nozzle axially fitted into said tubular supporting arrangement in a freely rotatable, vertically shiftable arrangement, wherein said water ejector nozzle is housed in said fitted-in ball bushing;

wherein said socket has, structured and arranged on its inner surface, a plurality of longitudinal protrusions having a concave profile in the vicinity of each opening of said socket.

4. A swimming pool bottom flushing device as in claim 3, wherein said ball bushing further comprises an outer all-around flange at its top edge for fitting over the open end of said pipe.

* * * * *